US010672570B2

(12) United States Patent
Chen et al.

(10) Patent No.: US 10,672,570 B2
(45) Date of Patent: Jun. 2, 2020

(54) KEYSWITCH STRUCTURE

(71) Applicant: DARFON ELECTRONICS CORP., Taoyuan (TW)

(72) Inventors: Chih-Hao Chen, Taoyuan (TW); Po-Wei Tsai, Taoyuan (TW); Chun-Yuan Wang, Taoyuan (TW); Kuan-Te Lin, Taoyuan (TW); Shao-Wei Yang, Taoyuan (TW); Ling-Hsi Chao, Taoyuan (TW)

(73) Assignee: DARFON ELECTRONICS CORP., Taoyuan (TW)

( * ) Notice: Subject to any disclaimer, the term of this patent is extended or adjusted under 35 U.S.C. 154(b) by 21 days.

(21) Appl. No.: 16/245,213

(22) Filed: Jan. 10, 2019

(65) Prior Publication Data

US 2019/0221384 A1 Jul. 18, 2019

(30) Foreign Application Priority Data

Jan. 12, 2018 (TW) ..... 107101226 A
Jan. 9, 2019 (TW) ..... 108100855 A

(51) Int. Cl.
*H01H 13/7065* (2006.01)
*H01H 13/14* (2006.01)
*H01H 3/12* (2006.01)

(52) U.S. Cl.
CPC ..... *H01H 13/7065* (2013.01); *H01H 3/122* (2013.01); *H01H 13/14* (2013.01); *H01H 2237/004* (2013.01)

(58) Field of Classification Search
CPC ..... H01H 3/125; H01H 13/705; H01H 13/14; H01H 13/7065; H01H 13/70; H01H 13/20;
(Continued)

(56) References Cited

U.S. PATENT DOCUMENTS 5,457,297 A * 10/1995 Chen ..... H01H 3/125 200/344
5,504,283 A * 4/1996 Kako ..... H01H 3/125 200/344
(Continued)

FOREIGN PATENT DOCUMENTS

CN 1188976 A 7/1998
CN 2325864 Y 6/1999
(Continued)

*Primary Examiner* — Ahmed M Saeed
(74) *Attorney, Agent, or Firm* — Winston Hsu

(57) ABSTRACT

A keyswitch structure includes a base plate, a keycap, a first support, and a second support. The keycap is located above the base plate. The first support is connected to and between the keycap and the base plate and has an upper connection portion, a lower connection portion, and a protruding limitation portion. The upper connection portion is located between the lower connection portion and the protruding limitation portion. The first support is rotatably connected to the keycap and the base plate through the upper connection portion and the lower connection portion respectively. The protruding limitation portion is located close to and under the cap body. The second support is connected to and between the keycap and the base plate. The keycap moves up and down relative to the base plate through the first support and the second support.

8 Claims, 19 Drawing Sheets

(58) Field of Classification Search
CPC . H01H 2233/07; H01H 2239/056; H01H 3/12
See application file for complete search history.

(56) References Cited

U.S. PATENT DOCUMENTS

| | | | | | |
|---|---|---|---|---|---|
| 5,828,015 | A * | 10/1998 | Coulon | H01H 3/125 | 200/5 A |
| 5,964,341 | A * | 10/1999 | Tsai | H01H 3/125 | 200/344 |
| 7,183,512 | B2 * | 2/2007 | Lee | H01H 3/125 | 200/344 |
| 2012/0080299 | A1 * | 4/2012 | Chen | H01H 13/83 | 200/5 A |

FOREIGN PATENT DOCUMENTS

| | | | |
|---|---|---|---|
| CN | 2726089 | Y | 9/2005 |
| CN | 201590361 | U | 9/2010 |
| CN | 201754380 | U | 3/2011 |
| CN | 204808117 | U | 11/2015 |
| EP | 1 361 589 | B1 | 6/2005 |
| EP | 1 612 821 | B1 | 1/2014 |
| TW | 201303941 | A1 | 1/2013 |
| TW | M467938 | | 12/2013 |
| TW | 201426795 | A | 7/2014 |
| TW | I469172 | B | 1/2015 |
| TW | M503647 | U | 6/2015 |
| TW | 201608586 | A | 3/2016 |
| TW | I550668 | | 9/2016 |
| TW | M547172 | U | 8/2017 |
| TW | 201812816 | A | 4/2018 |

* cited by examiner

KEYSWITCH STRUCTURE

BACKGROUND OF THE INVENTION

1. Field of the Invention

The present invention relates to a keyswitch structure, and more particularly to a mechanical keyswitch structure.

2. Description of the Prior Art

For conventional keyswitch structures having a scissors-type support, the keycap thereof can move up and down relative to the base plate thereof through the scissors-type support. The keycap and the scissors-type support are usually connected through connection structures. In order for the scissors-type support to act smoothly (e.g. rotate relative to the base plate and the keycap) and in order to facilitate the assembly of the keyswitch structure, the connection structures are usually not strong and gaps exist between the connection structures and the scissors-type support. Especially when the keyswitch structure is small in size, a pull-off force of the keycap relative to the scissors-type support (i.e. the force that is required to depart the keycap vertically upward from the scissors-type support) decreases accordingly, which makes it possible to lift the keycap carelessly by a user. Manufacturing tolerances of the components of the keyswitch structure also can enlarge the above gaps, which makes the above problem worse. Furthermore, the above gaps also affect the stability in height of the keyswitch structure (or the highest position of the keycap). For example, the keycap may be loose relative to the scissors-type support, so that the vertical position of the keycap when un-pressed varies. When the keyswitch structure is small in size, a ratio of a vertical position variation of the keycap because of the lossing to the whole height of the keyswitch structure (or to the displacement of the up-and-down motion of the keycap) increases, so that users will have bad experience in operating the keyswitch structure, e.g. unstable force feedback when pressing the keycap, unstable pressing displacement, and so on.

SUMMARY OF THE INVENTION

The present disclosure provides a keyswitch structure, which uses structural constraint to increase the structural limitations between its keycap and supports so as to enhance the disposition stability of the keycap.

A keyswitch structure according to the present invention includes a base plate, a keycap, a first support, and a second support. The keycap is disposed above the base plate. The first support is connected to and between the keycap and the base plate. The first support has an upper connection portion, a lower connection portion, and a protruding limitation portion. The upper connection portion is located between the lower connection portion and the protruding limitation portion. The first support is rotatably connected to the keycap and the base plate through the upper connection portion and the lower connection portion respectively. The protruding limitation portion is disposed close to and under the keycap. The second support is connected to and between the keycap and the base plate. The keycap moves up and down along a vertical direction relative to the base plate through the first support and the second support. Thereby, the keycap and the protruding limitation portion have structural constraint on each other, which can enhance the disposition stability of the keycap, so as to solve the problem in the prior art.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
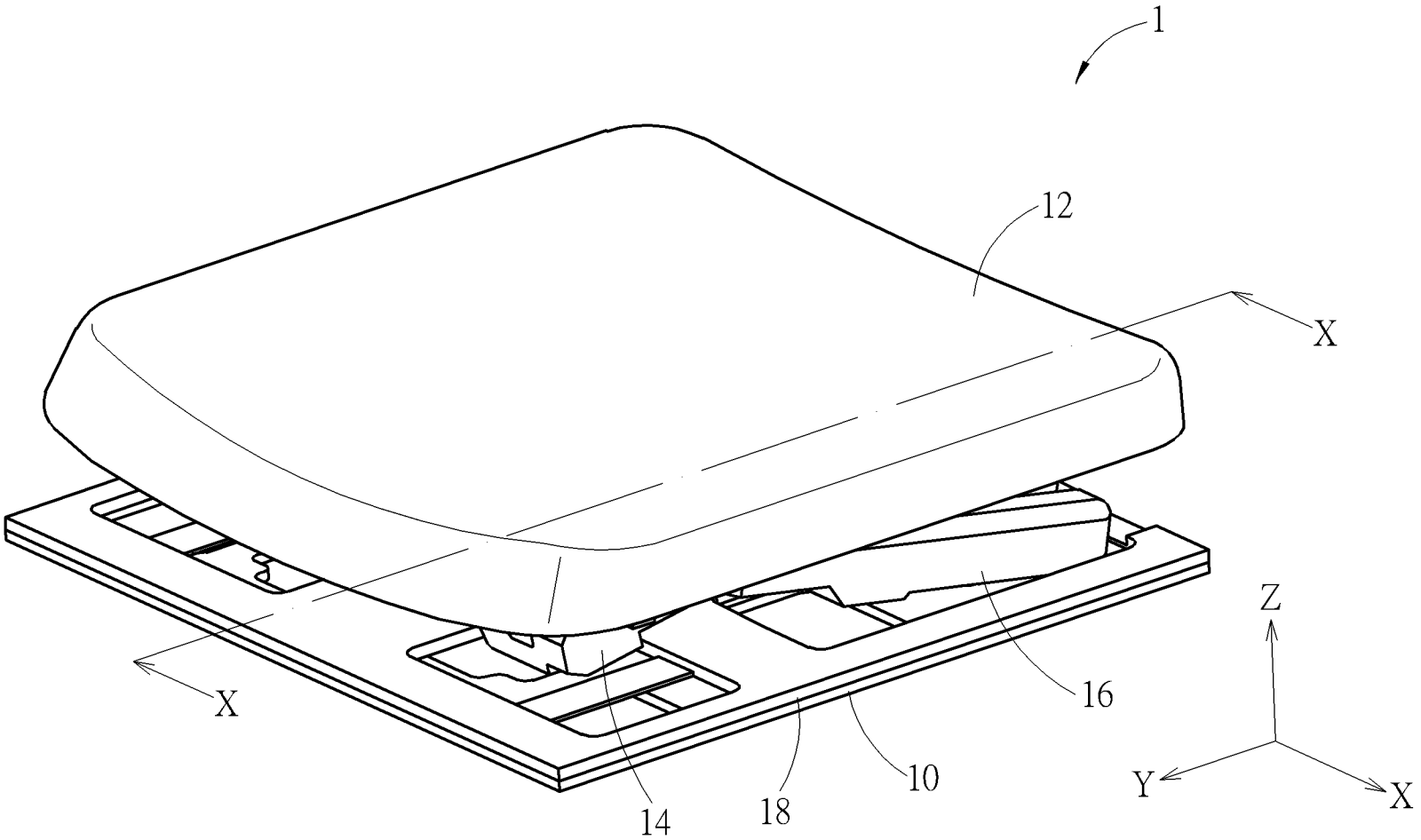
FIG. 1 is a schematic diagram illustrating a keyswitch structure of an embodiment according to the invention.
Figure 2:
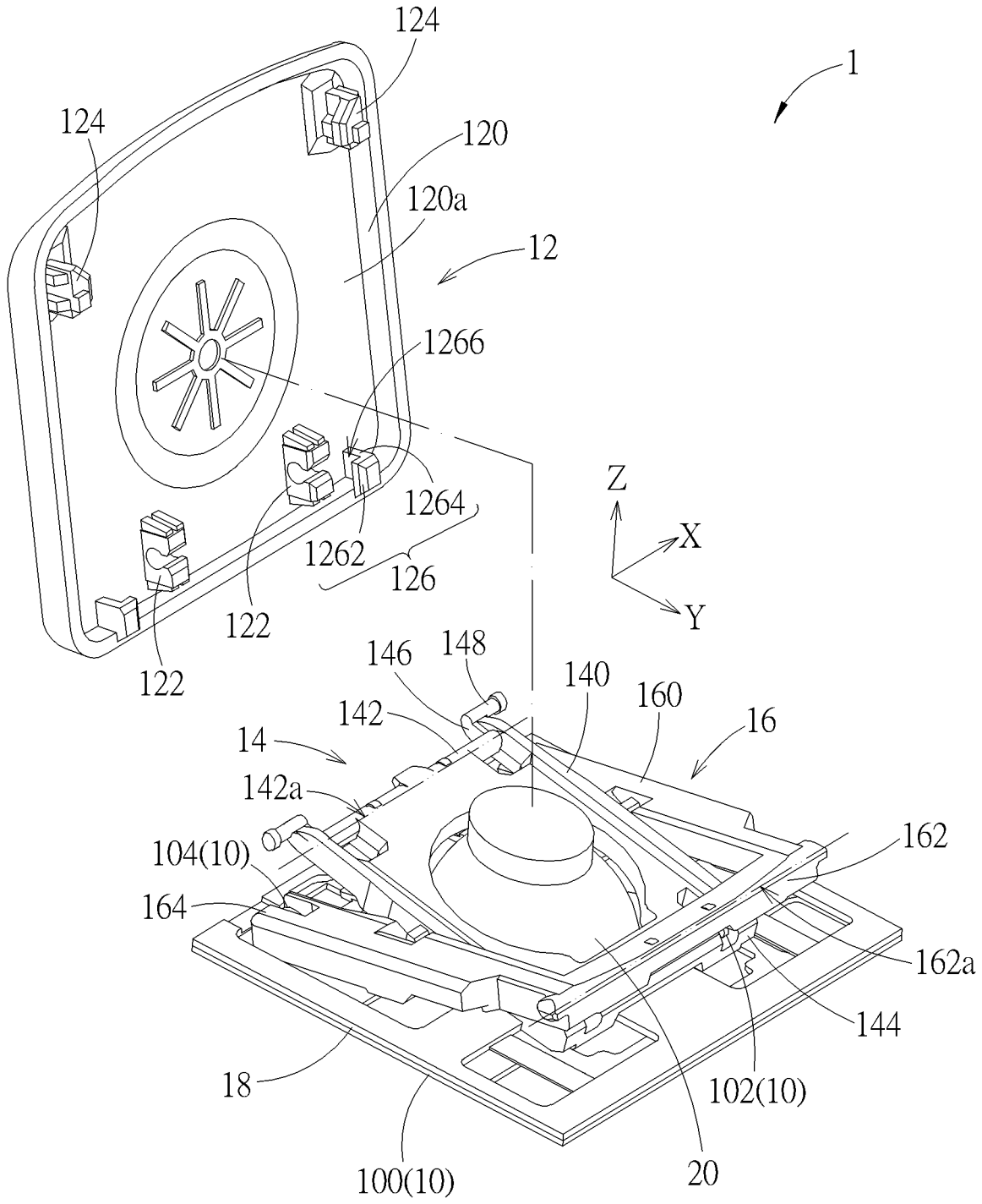
FIG. 2 is a partially-exploded view of the keyswitch structure in FIG. 1.
Figure 3:
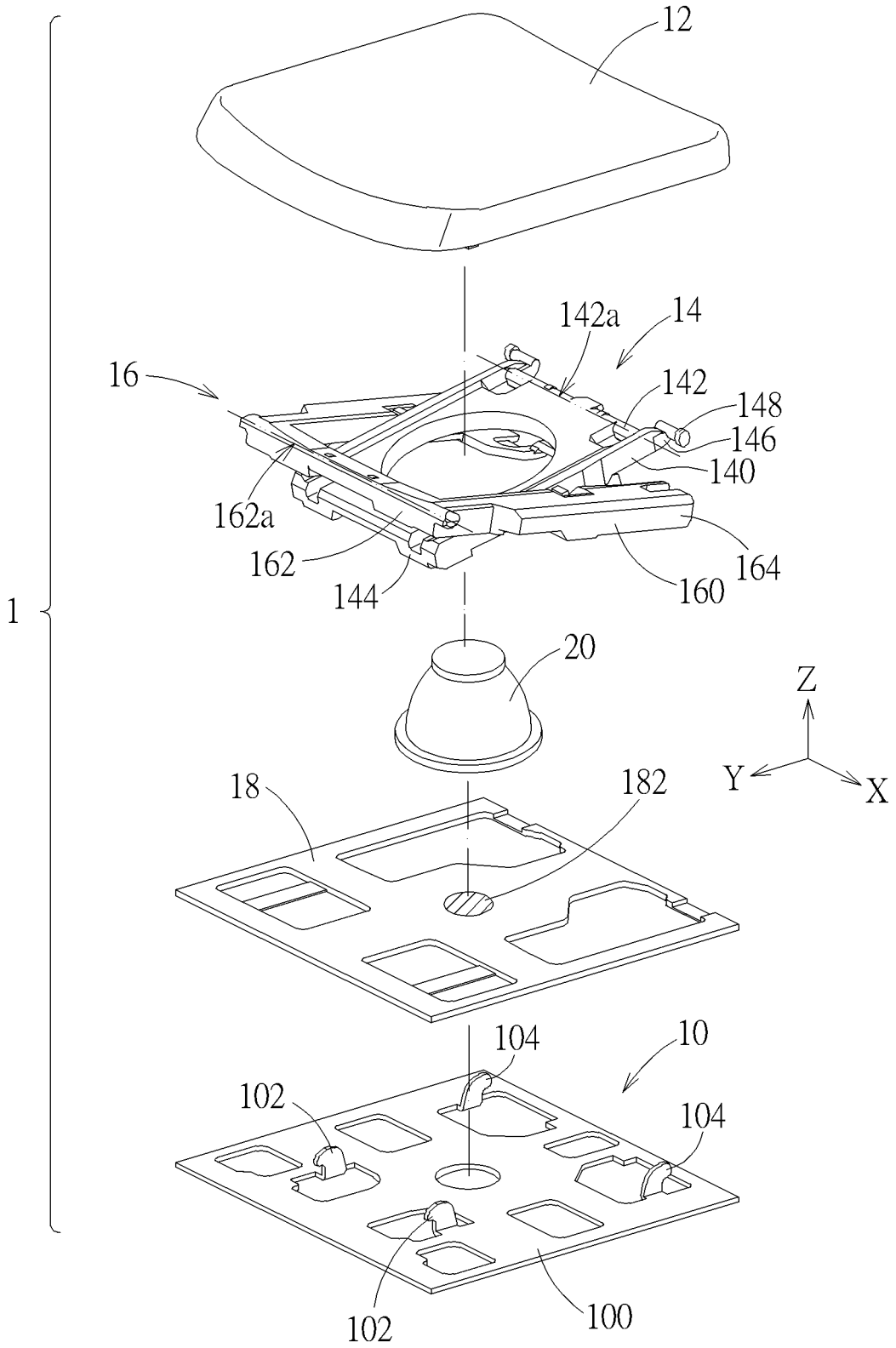
FIG. 3 is an exploded view of the keyswitch structure in FIG. 1.

Please refer to FIG. 1 to FIG. 5. A keyswitch structure 1 of an embodiment according to the invention includes a base plate 10, a keycap 12, a first support 14, a second support 16, a membrane circuit board 18, and a resilient part 20. The base plate 10 includes a plate body 100 and a plurality of connection structures 102 and 104 disposed on the plate body 100. In practice, the base plate 10 can be realized by, but not limited to, a single metal plate (e.g. by pressing and forming). The keycap 12 is disposed above the base plate 10. The keycap 12 includes a cap body 120 and a plurality of connection structures 122 and 124 disposed on the cap body 120 (or on a lower surface 120*a* of the cap body 120 that faces the base plate 10). In practice, the keycap 12 can be realized by, but not limited to, a plastic plate (e.g. by plastics injection molding). The first support 14 is connected to and between the keycap 12 and the base plate 10. The first support 14 has a first main body 140 and a first upper connection portion 142 and a first lower connection portion 144 that are located at two opposite sides of the first main body 140. In practice, the first support 14 can be realized by, but not limited to, a plastic plate (e.g. by plastics injection molding). The first support 14 is rotatably connected to the connection structures 122 of the keycap 12 and the connection structures 102 of the base plate 10 through the first upper connection portion 142 and the first lower connection portion 144 respectively, so the first upper connection portion 142 can rotate around a rotation axis 142*a* (indicated by a chain line or a cross mark in the figures) relative to the keycap 12 (or rotate around an X-axis). The first lower connection portion 144 can rotate around the X-axis relative to the base plate 10. In the embodiment, the connection structure 122 is a pivotal connection structure, for example, that shows a C-shaped clamping structure for holding the first upper connection portion 142 so that the first upper connection portion 142 and the connection structure 122 are pivotally connected with each other. However, in practice, it is not limited thereto. For example, the connection structure 122 is realized by a sliding slot, so that the first upper connection portion 142 also can slide parallel to a Y-axis relative to the keycap 12.

The second support 16 is connected to and between the keycap 12 and the base plate 10. The second support 16 has a second main body 160 and a second upper connection portion 162 and a second lower connection portion 164 that are located at two opposite sides of the second main body 160. In practice, the second support 16 can be realized by, but not limited to, a plastic part (e.g. plastics injection molding). The second support 16 is rotatably connected to the connection structures 124 of the keycap 12 and the connection structures 104 of the base plate 10 through the second upper connection portion 162 and the second lower connection portion 164 respectively, so the second upper connection portion 162 can rotate around a rotation axis 162*a* (indicated by a chain line or a cross mark in the figures) relative to the keycap 12 (or rotate around the X-axis). The second lower connection portion 164 can rotate around the X-axis relative to the base plate 10. Furthermore, in the embodiment, the connection structure 124 is a sliding slot, so that the second upper connection portion 162 also can slide parallel to a Y-axis relative to the keycap 12. The keycap 12 can move up and down along a vertical direction relative to the base plate 10 (or move along a Z-axis). Furthermore, in the embodiment, the first support 14 and the second support 16 are pivotally connected with each other relative to the X-axis. However, in practice, it is not limited thereto. For example, the first support 14 and the second support 16 are disposed separately and opposite to each other. The first support 14 and the second support 16 are independently connected to and between the keycap 12 and the base plate 10.

The membrane circuit board 18 is disposed between the base plate 10 and the keycap 12 and is placed on the base plate 10. The membrane circuit board 18 has a switch 182 (shown by a hatched circle in FIG. 3). In the embodiment, the membrane circuit board 18 is usually provided by three stacked transparent sheets. Therein, the upper and lowers transparent sheets are provided with circuits thereon. The middle transparent sheet servers as an insulation layer to the circuits. The circuits form the switch 182. Furthermore, for simplification of drawings, in FIG. 1 to FIG. 5, the membrane circuit board 18 is shown by a single plate. The resilient part 20 is disposed between the keycap 12 and the base plate 10 corresponding to the switch 182, or abuts against and between the keycap 12 and the membrane circuit board 18. The resilient part 20 can be deformed elastically and produce restoration force accordingly. The resilient part 20 is usually made of rubber. Furthermore, when the keycap 12 is pressed to move to a pressed position (as shown by FIG. 5), the keycap 12 can compress the resilient part 20 to be elastically deformed to trigger the switch 182. Then, when the force that presses the keycap 12 is eliminated, the resilient force produced by the elastically deformed resilient part 20 can return the keycap 12 to its original position (i.e. an un-pressed position, as shown by FIG. 1 or FIG. 4).

In the embodiment, the keycap 12 further includes a first limitation structure 126. The first limitation structure 126 is disposed on the cap body 120 (or the lower surface 120*a* thereof) and has a first blocking portion 1262 and a side wall portion 1264. The first blocking portion 1262 is located between the cap body 120 and the base plate 10. The side wall portion 1264 connects the first blocking portion 1262 and the cap body 120. In the embodiment, the connection structures 122 and 124 and the first limitation structure 126 are disposed on the lower surface 120*a* of the base plate 10 that faces the base plate 10. Furthermore, the first support 14 further includes an extending connection portion 146 and a first protruding limitation portion 148. The extending connection portion 146 extends outward perpendicular to the X-axis from the first upper connection portion 142 opposite to the first lower connection portion 144. The first protruding limitation portion 148 is connected to the first upper connection portion 142 through the extending connection portion 146 and extends parallel to the X-axis from the extending connection portion 146. The first upper connection portion 142 is located between the first lower connection portion 144 (or the first main body 140) and the first protruding limitation portion 148. The first protruding limitation portion 148 is disposed between the first blocking portion 1262 and the cap body 120. Thereby, detaching the keycap 12 from the keyswitch structure 1 (or from the first support 14 and the second portion 16) needs to overcome the structural constraint of the connection structures 122 and 124 and the first limitation structure 126 to the first support 14 and the second support 16. In other words, the first limitation structure 126 has the effect of increasing the pull-off force required for departing the keycap 12 from the keyswitch structure 1 (or the first support 14).

Figure 4:
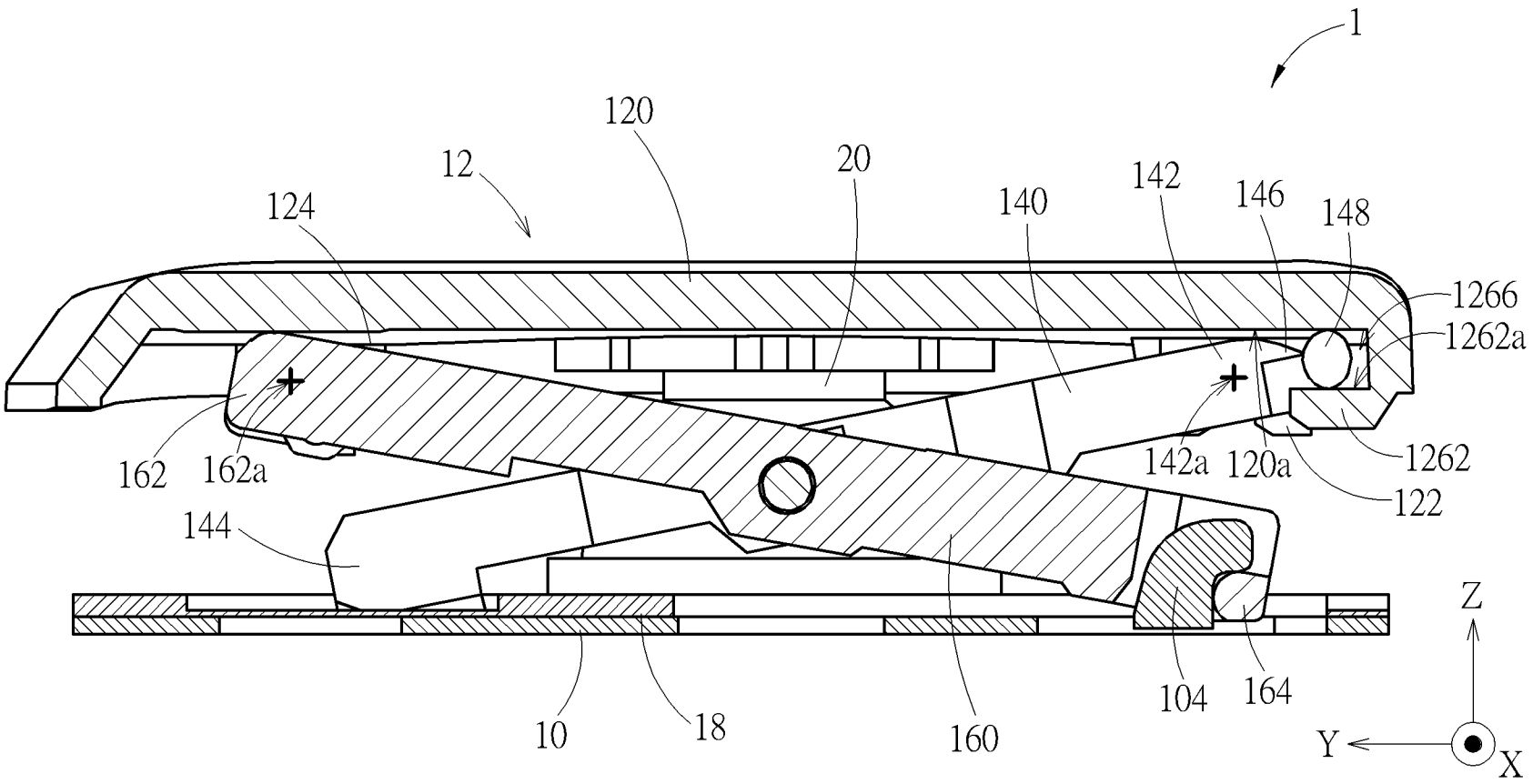
FIG. 4 is a sectional view of the keyswitch structure along the line X-X in FIG. 1 when the keycap thereof is not pressed yet.
Figure 5:
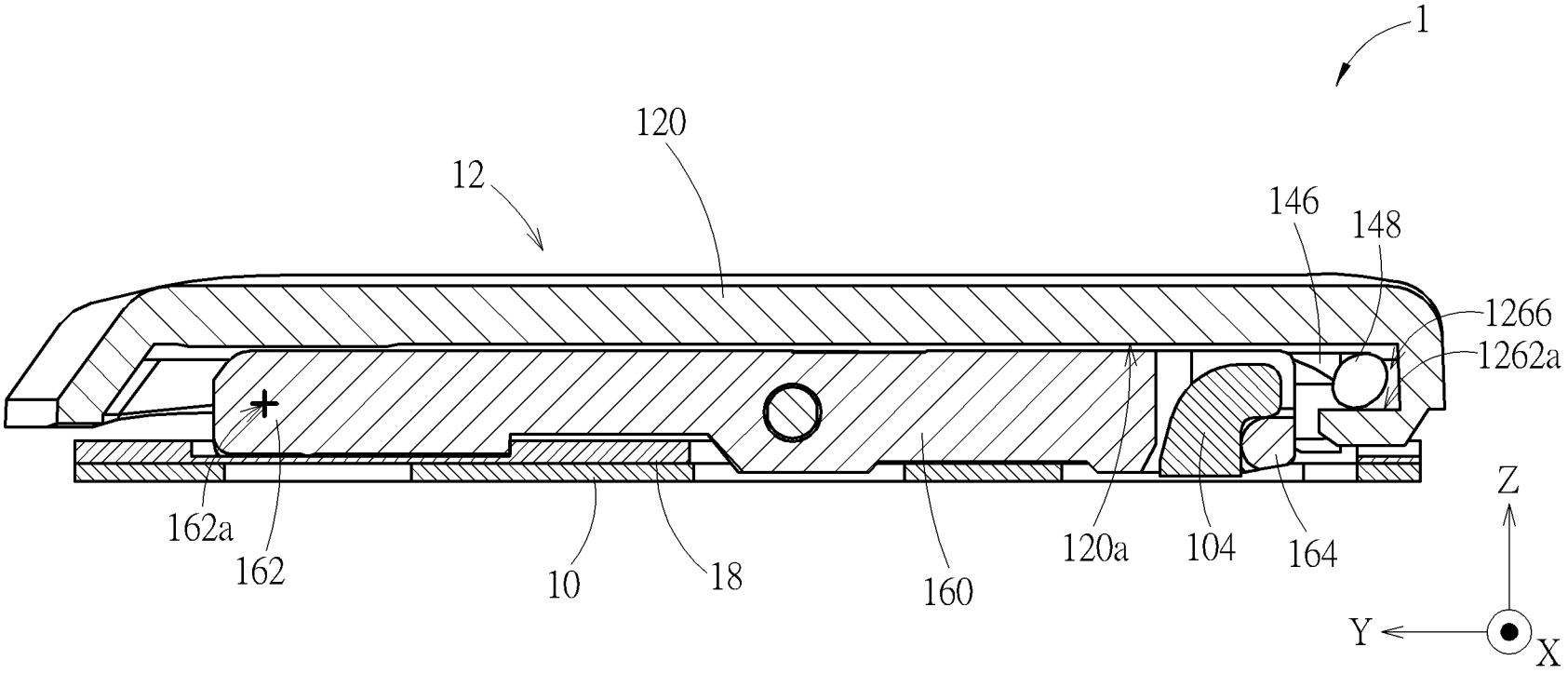
FIG. 5 is a sectional view of the keyswitch structure along the line X-X in FIG. 1 when the keycap thereof is pressed.
Figure 6:
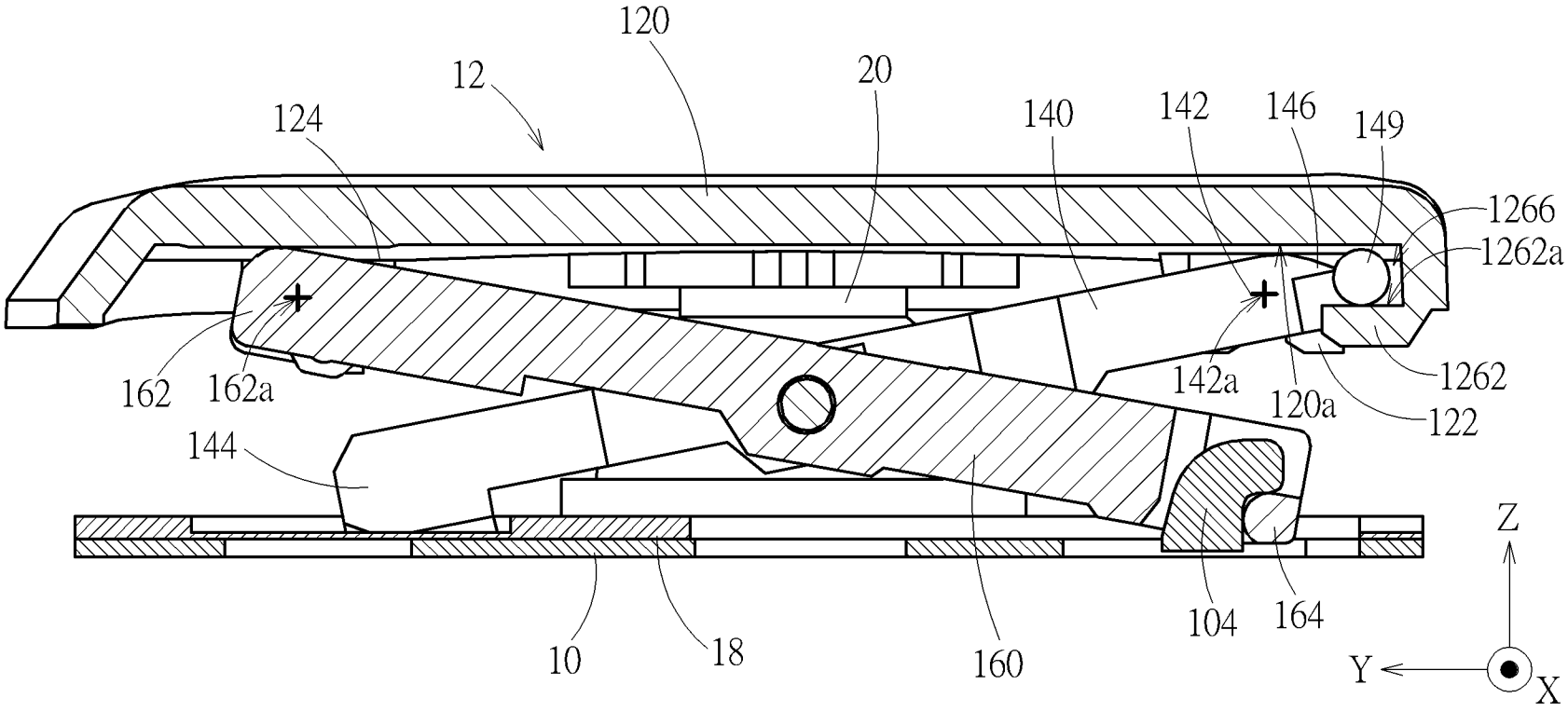
FIG. 6 is a sectional view of a keyswitch structure according to another embodiment when the keycap thereof is not pressed yet; therein the position of the cutting plane therefor refers to the line X-X in FIG. 1.

Furthermore, as shown by FIG. 4, when the keycap 12 is not pressed yet, the keycap 12 is located at the un-pressed position, and the first protruding limitation portion 148 abuts against a surface 1262*a* of the first blocking portion 1262 that faces the cap body 120. Thereby, by the first protruding limitation portion 148 abutting against the surface 1262*a*, the highest position of the keycap 12 relative to the base plate 10 (i.e. the farthest position of the keycap 12 in the Z-axis relative to the base plate 10) can be limited or controlled. In a practical application, even though the connection structure 122 and the first upper connection portion 142 are provided with a certain design tolerance (e.g. for assembling or smooth motions of the components) and a manufacturing tolerance (e.g. the manufacturing variation based on mass production), the highest position of the keycap 12 relative to the base plate 10 still can be effectively limited or controlled by the first protruding limitation portion 148 abutting against the surface 1262*a*. Furthermore, in the embodiment, when the keycap 12 is located at the un-pressed position, the first protruding limitation portion 148 also abuts against the lower surface 120*a* of the cap body 120 that faces the first blocking portion 1262. In other words, when the keycap 12 is located at the un-pressed position, the first protruding limitation portion 148 is structurally constrained in the Z-axis by the lower surface 120*a* and the surface 1262*a* at the same time, which is conducive to the effect of limiting or controlling the highest position of the keycap 12 relative to the base plate 10. In the embodiment, a projection of the first protruding limitation portion 148 in the X-axis (or a section thereof perpendicular to the X-axis) has an ellipse profile (e.g. the first protruding limitation portion 148 is an ellipse post), so as to perform the above effect of constraining the first protruding limitation portion 148 in the Z-axis by the lower surface 120*a* and the surface 1262*a*. However, it is not limited thereto in practice. For example, a projection of the first protruding limitation portion 148 in the X-axis shows an I-shaped profile. The upper and lower portions thereof can abut against the lower surface 120*a* and the surface 1262*a* at the same time when the keycap 12 is located at the un-pressed position, which also can perform the above structural constraint on the first protruding limitation portion 148. Furthermore, it is practicable for the first protruding limitation portion 148 to elastically abut against the lower surface 120*a*; that is, a prepressing exists between the first protruding limitation portion 148 and the lower surface 120*a*. The prepressing is conducive to avoidance of a wobble of the keycap 12 (i.e. the case that the position of the keycap 12 is unstable when a finger starts to press the keycap 12). In addition, if the keyswitch structure 1 is designed to limit the highest position of the keycap 12 relative to the base plate 10 by the first protruding limitation portion 148 abutting against the surface 1262*a*, the first protruding limitation portion 148 can be realized by a round post 149, as shown by FIG. 6.

Furthermore, in the embodiment, as shown by FIG. 5, when the keycap 12 is pressed to move to the pressed position, the first protruding limitation portion 148 does not touch the lower surface 120*a* and the surface 1262*a*. Therefore, in this case, the first protruding limitation portion 148 only touches the lower surface 120*a* (and the surface 1262*a*) when the keycap 12 is at the un-pressed position in practice. This design can reduce friction between the first protruding limitation portion 148 and the lower surface 120*a* (and the surface 1262*a*), so that the highest position of the keycap 12 relative to the base plate 10 still can remain stable for long-term usage. In addition, in the embodiment, the side wall portion 1264, the first blocking portion 1262, and the cap body 120 form a sliding slot 1266 therebetween. The first protruding limitation portion 148 slides in the sliding slot 1266.

Furthermore, in the embodiment, the first support 14 and the second support 16 are symmetric structures. The first support 14 has the structural constraint of the first limitation structure 126 and the first protruding limitation portion 148 at both sides thereof (relative to the Y-axis). However, it is not limited thereto in practice. For example, the structural constraint of the first limitation structure 126 and the first protruding limitation portion 148 exists only at one side, which still can increase the pull-off force of the keycap 12 to a certain degree and limit or control the highest position of the keycap 12. Furthermore, in the above embodiments, the first support 14 is an inner ring support; the second support 16 is an outer ring support. However, in practice, the structural constraint of the first limitation structure 126 and the first protruding limitation portion 148 also can be applied to the second support 16, which will not be described in addition.

Figure 7:
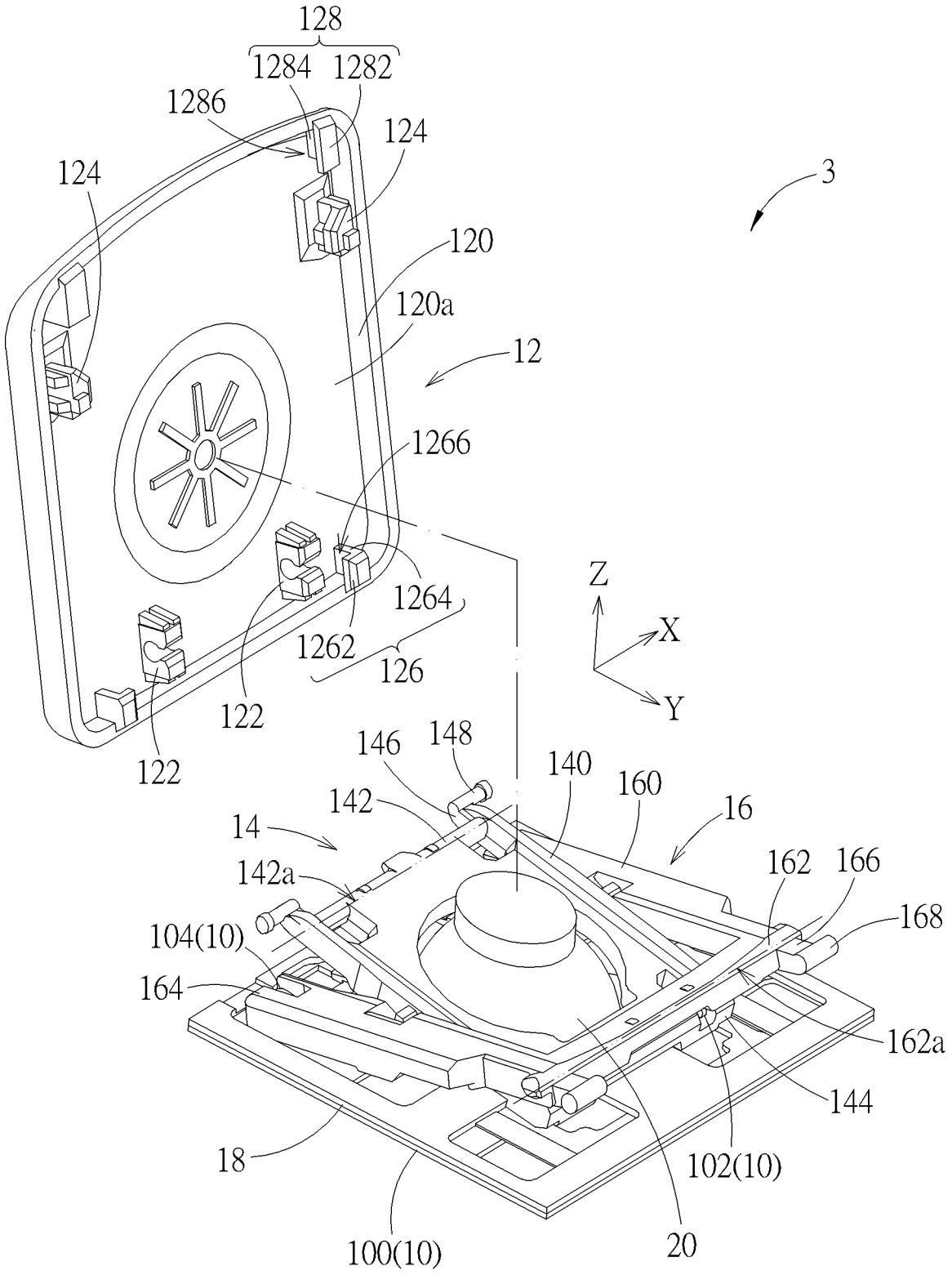
FIG. 7 is a partially-exploded view of a keyswitch structure according to another embodiment.
Figure 8:
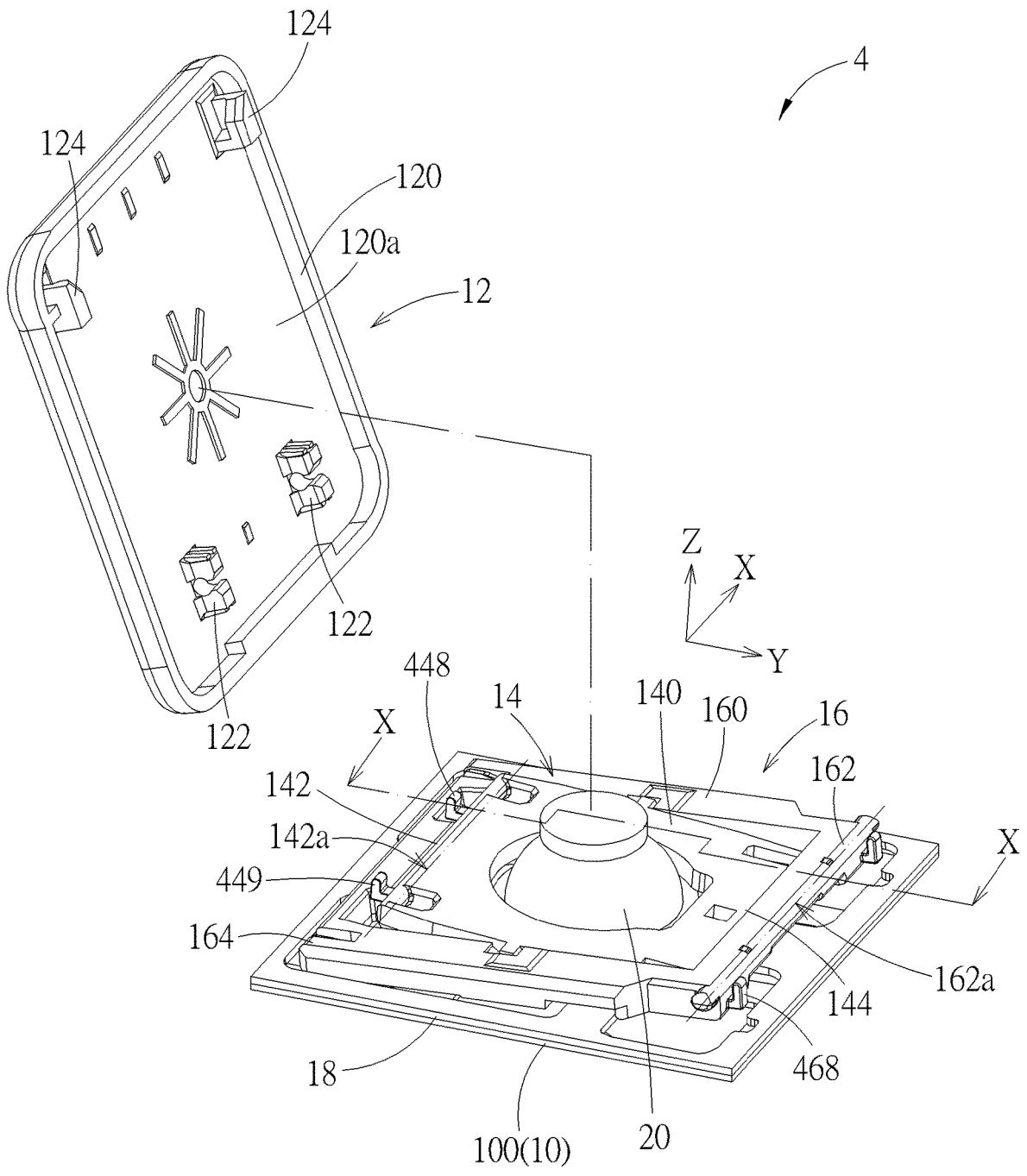
FIG. 8 is a partially-exploded view of a keyswitch structure of another embodiment according to the invention.

Furthermore, in the embodiment, the structural constraint of the first limitation structure 126 and the first protruding limitation portion 148 exists only on the first support 14. However, it is not limited thereto. As shown in FIG. 7, a keyswitch structure 3 in FIG. 7 is structurally similar to the keyswitch structure 1, so the keyswitch structure 3 uses the reference numbers of the keyswitch structure 1. For other descriptions about the keyswitch structure 3, please refer to the relevant descriptions of the keyswitch structure 1, which will not be repeated in addition. Compared with the keyswitch structure 1, the keycap 12 of the keyswitch structure 3 further includes a second limitation structure 128. The second limitation structure 128 is disposed on the cap body 120 (or the lower surface 120*a* thereof) and has a second blocking portion 1282, and a side wall portion 1284. The second blocking portion 1282 is located between the cap body 120 and the base plate 10. The side wall portion 1284, the second blocking portion 1282, and the cap body 120 form a sliding slot 1286 therebetween. The second support 16 further includes an extending connection portion 166 and a second protruding limitation portion 168. The second upper connection portion 162 is located between the second lower connection portion 164 (or the second main body 160) and the second protruding limitation portion 168. The second protruding limitation portion 168 is disposed between the second blocking portion 1282 and the cap body 120 and slides in the sliding slot 1286. Similarly, when the keycap 12 is located at an un-pressed position (equivalent to the case as shown by FIG. 4), the second protruding limitation portion 168 abuts the surface of the second blocking portion 1282 that faces the cap body 120 and the lower surface 120*a* of the cap body 120 that faces the base plate 10 at the same time (which is equivalent to the structural constraint of the surface 1262*a* and the lower surface 120*a* to the first protruding limitation portion 148). It also can perform the effect of increasing the pull-off force of the keycap 12 and limiting or controlling the highest position of the cap body 120 relative to the base plate 10. In the embodiment, the structural constraint of the second limitation structure 128 and the second protruding limitation portion 168 is essentially the same as the structural constraint of the first limitation structure 126 and the first protruding limitation portion 148. Thereby, for other descriptions about the structural constraint of the second limitation structure 128 and the second protruding limitation portion 168, please refer to the relevant descriptions of the structural constraint of the first limitation structure 126 and the first protruding limitation portion 148 and the descriptions about the variants thereof, which will not be repeatedly described.

Figure 9:
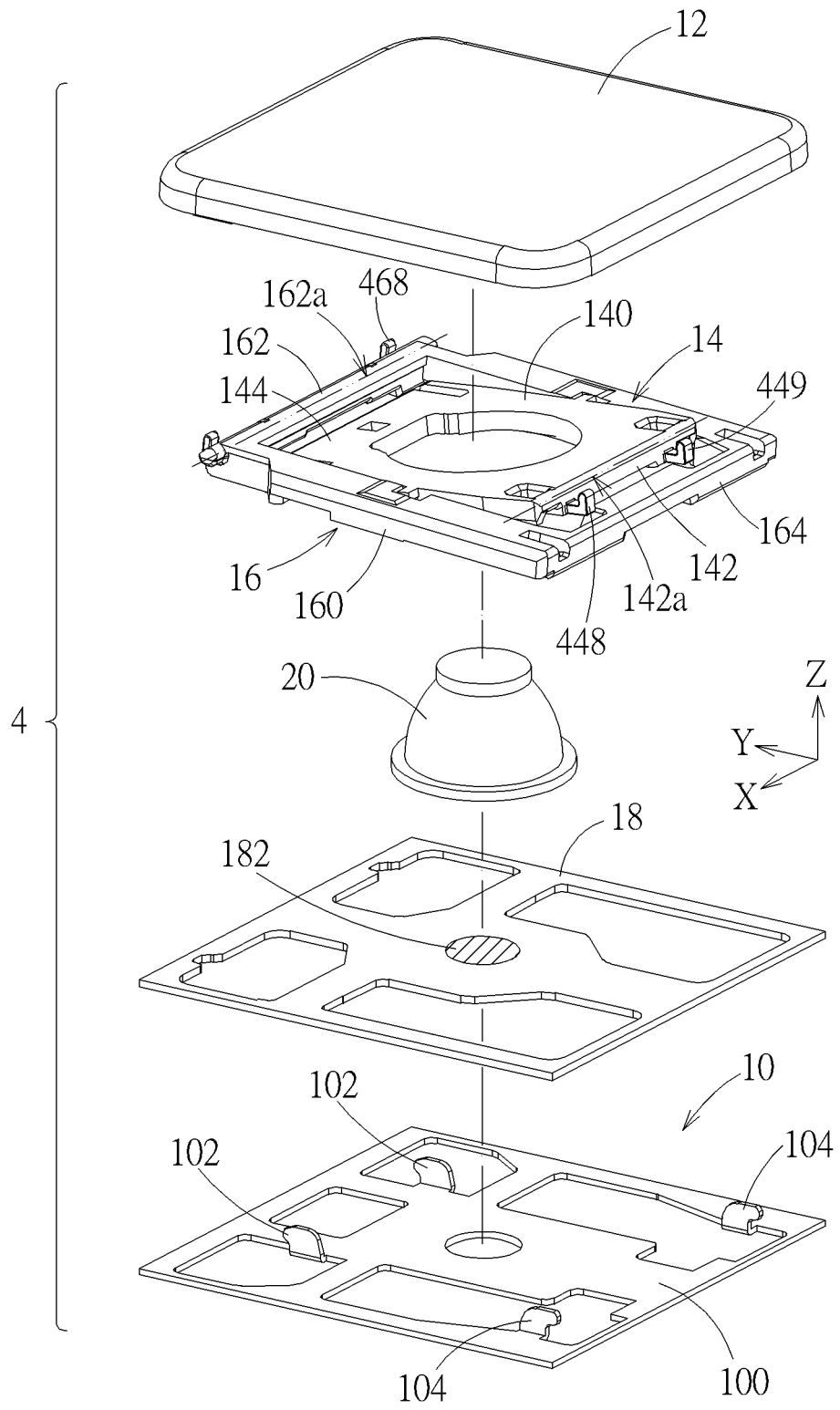
FIG. 9 is an exploded view of the keyswitch structure in FIG. 8.
Figure 10:
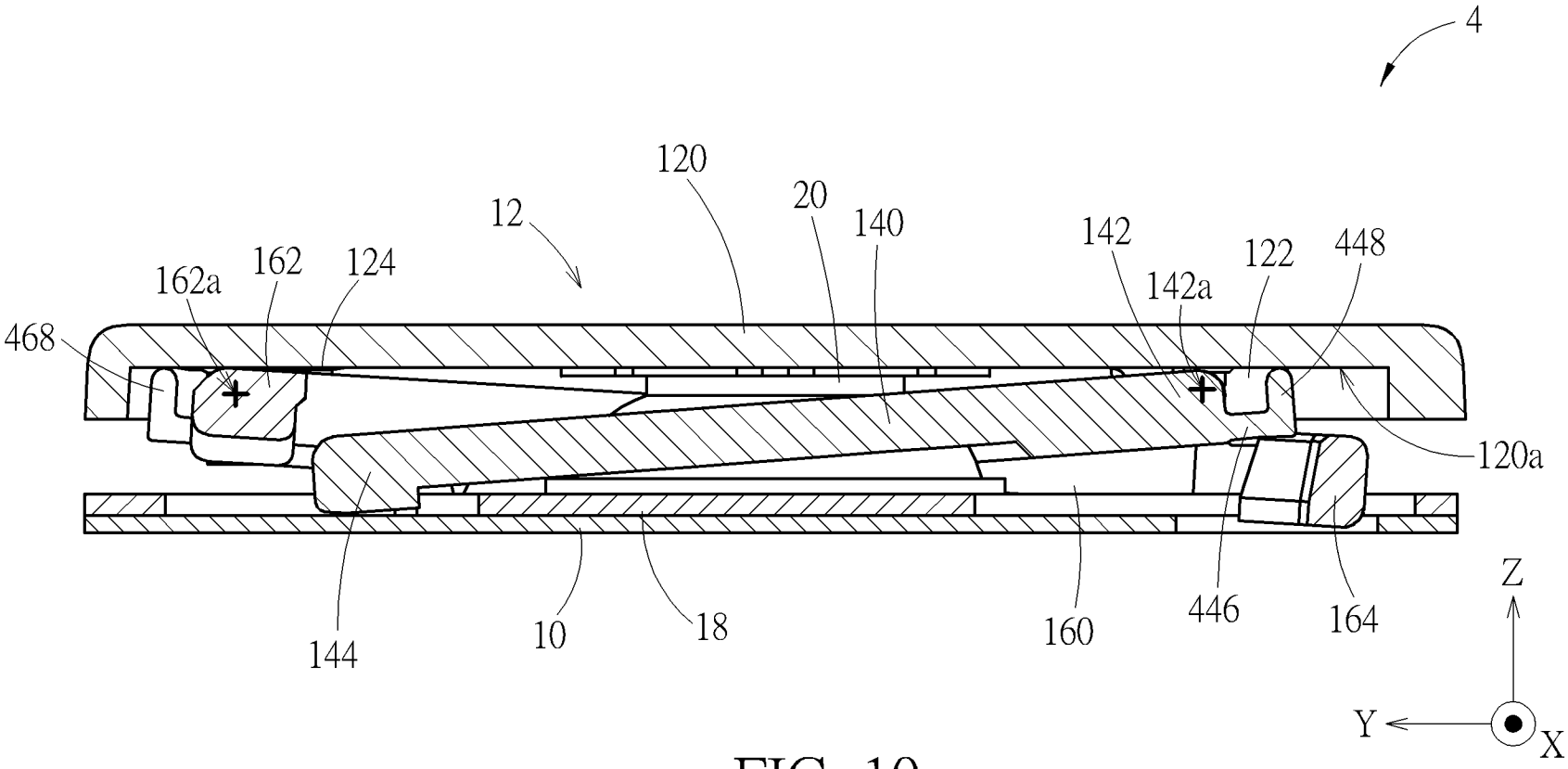
FIG. 10 is a sectional view of the keyswitch structure along the line Y-Y in FIG. 8 when the keycap thereof is not pressed yet.

Please refer to FIG. 8 to FIG. 11. A keyswitch structure 4 of another embodiment according to the invention is structurally similar to the keyswitch structure 1, so the keyswitch structure 4 uses the reference numbers of the keyswitch structure 1. For other descriptions about the keyswitch structure 4, please refer to the relevant descriptions of the keyswitch structure 1, which will not be repeated in addition. Compared with the keyswitch structure 1, when the keycap 12 of the keyswitch structure 4 is located at an un-pressed position (as shown by FIG. 10), the first protruding limitation portion 448 elastically abuts against the lower surface 120*a* of the keycap 12; that is, a prepressing exists between the first protruding limitation portion 448 and the lower surface 120*a*. In practice, the prepressing can be realized by a structural interference between the first protruding limitation portion 448 and the lower surface 120*a*. The prepressing is conducive to avoidance of a wobble of the keycap 12 (i.e. the case that the position of the keycap 12 is unstable when a finger starts to press the keycap 12).

Figure 11:
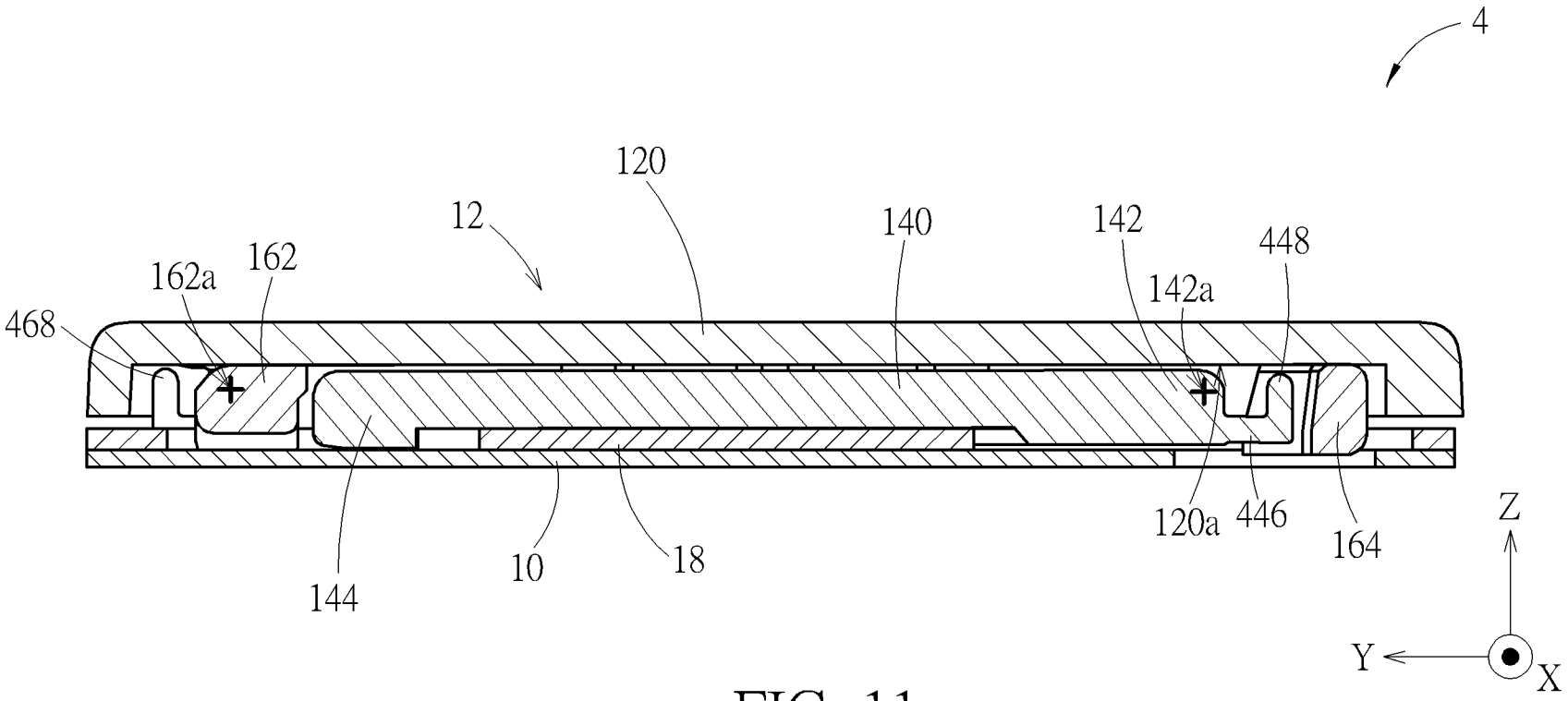
FIG. 11 is a sectional view of the keyswitch structure along the line Y-Y in FIG. 8 when the keycap thereof is pressed.
Figure 12:
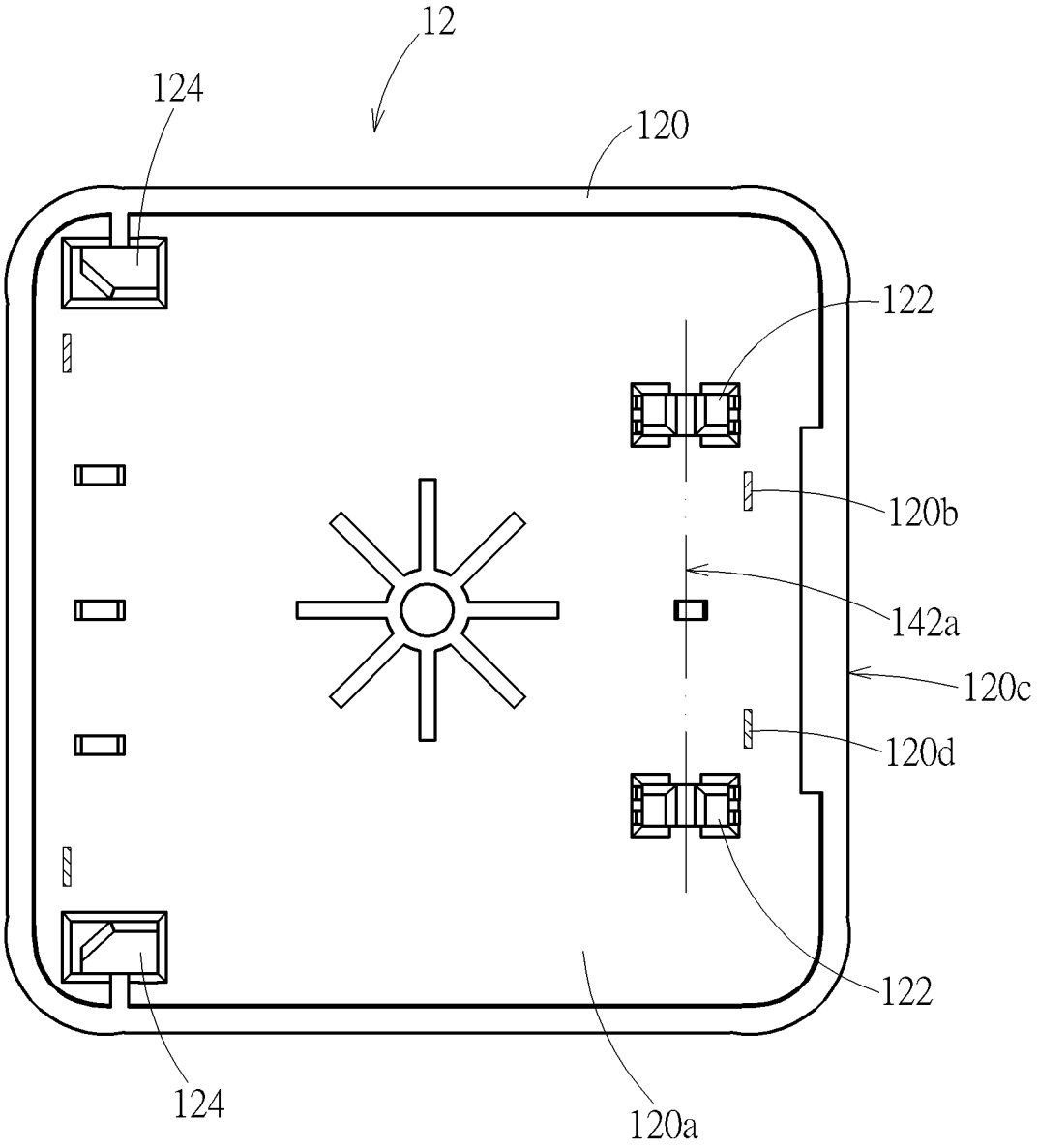
FIG. 12 is a bottom view of the keycap of the keyswitch structure.

Please also refer to FIG. 12; therein, an abutting position 120*b* of the lower surface 120*a* that the first protruding limitation portion 448 touches is indicated by a hatched rectangle, and a projection of the rotation axis 142*a* of the first upper connection portion 142 on the lower surface 120*a* is indicated by a chain line. In the embodiment, the keycap 12 has an edge 120*c* relatively close to the rotation axis 142*a*. The edge 120*c* is substantially parallel to the rotation axis 142*a*. when the keycap 12 is located at the un-pressed position, the abutting position 120*b* is located between the rotation axis 142*a* and the edge 120*c*; in other words, in the vertical direction, the projection of the first upper connection portion 142 is located between the projection of the first lower connection portion 144 and the projection of the portion of the lower surface 120*a* (i.e. the abutting position 120*b*) that the first protruding limitation portion 448 touches. Therefore, in principle, in the movement of the keycap 12 from the un-pressed position to a pressed position (i.e. the position of the keycap 12 in FIG. 11), the prepressing of the first protruding limitation portion 448 elastically abutting against the lower surface 120*a* gradually lessens. Furthermore, when the keycap 12 is located at the pressed position (as shown by FIG. 11), the first protruding limitation portion 448 does not touch the lower surface 120*a*. In practice, the structural interference between the first protruding limitation portion 448 and the keycap 12 when the keycap 12 is located at the un-pressed position can be designed such that the first protruding limitation portion 448 can depart from the lower surface 120*a* of the keycap 12 after the keycap 12 moves toward the pressed position by a small distance, which can avoid the prepressing from affecting the tactile feedback to users when pressing the keycap 12. For example, the first protruding limitation portion 448 has departed from the lower surface 120*a*, long before the switch 182 is triggered. In addition, in practice, the portion of the lower surface 120*a* that the first protruding limitation portion 448 touches is not limited to be a long area, and for example, can be a spot or a line (e.g. abutting against the lower surface 120*a* by a sharp structural edge). If the contact area between the first protruding limitation portion 448 and the lower surface 120*a* is much smaller than the lower surface 120*a* of the keycap 12, the contact area can be regarded as a point or a line in logic.

Figure 13:
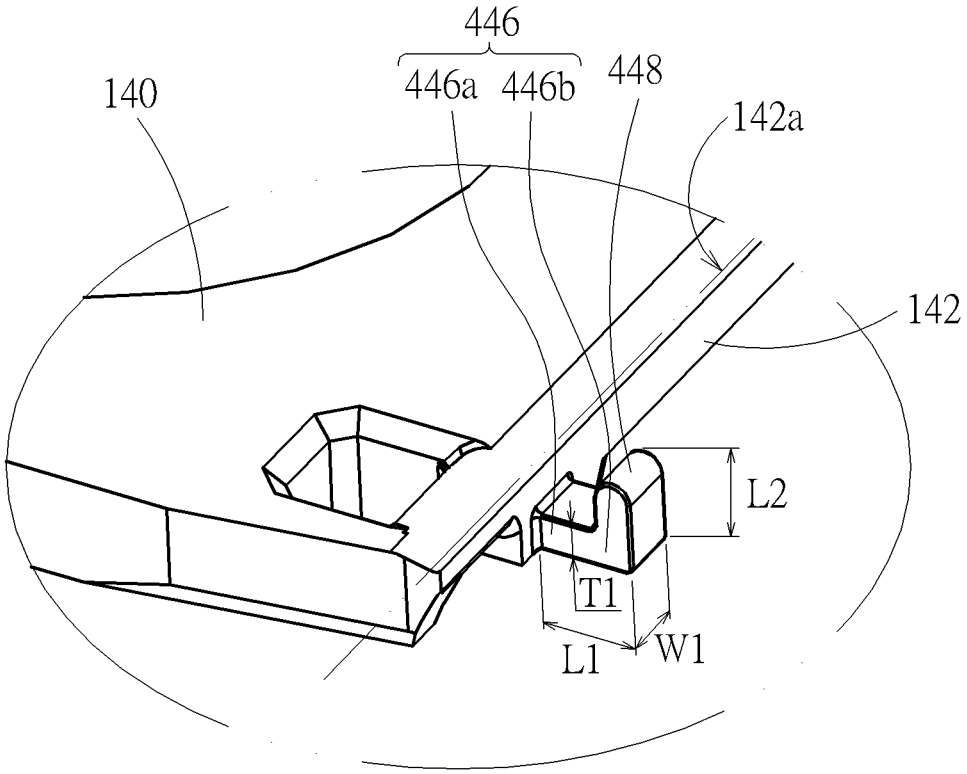
FIG. 13 is a schematic diagram illustrating a portion of a first support of the keyswitch structure.

Please also refer to FIG. 13. In the embodiment, the first support 14 has an extending connection portion 446 that has a fixed end portion 446*a* and a free end portion 446*b*. The first protruding limitation portion 448 is located at the free end portion 446*a*. The first protruding limitation portion 448 and the extending connection portion 446 form an elastic structure (for example but not limited to an L-shaped structure), as a whole showing a cantilever structure. When the keycap 12 is located at the un-pressed position, the elastic structure elastically abuts against the lower surface 120*a* through the first protruding limitation portion 448. In practice, the prepressing between the first protruding limitation portion 448 and the lower surface 120*a* can be adjusted by changing the dimensions of the elastic structure, for example, by changing (or designing) the lengths L1 and L2, thickness T1, width W1, and so on of the elastic structure.

Figure 14:
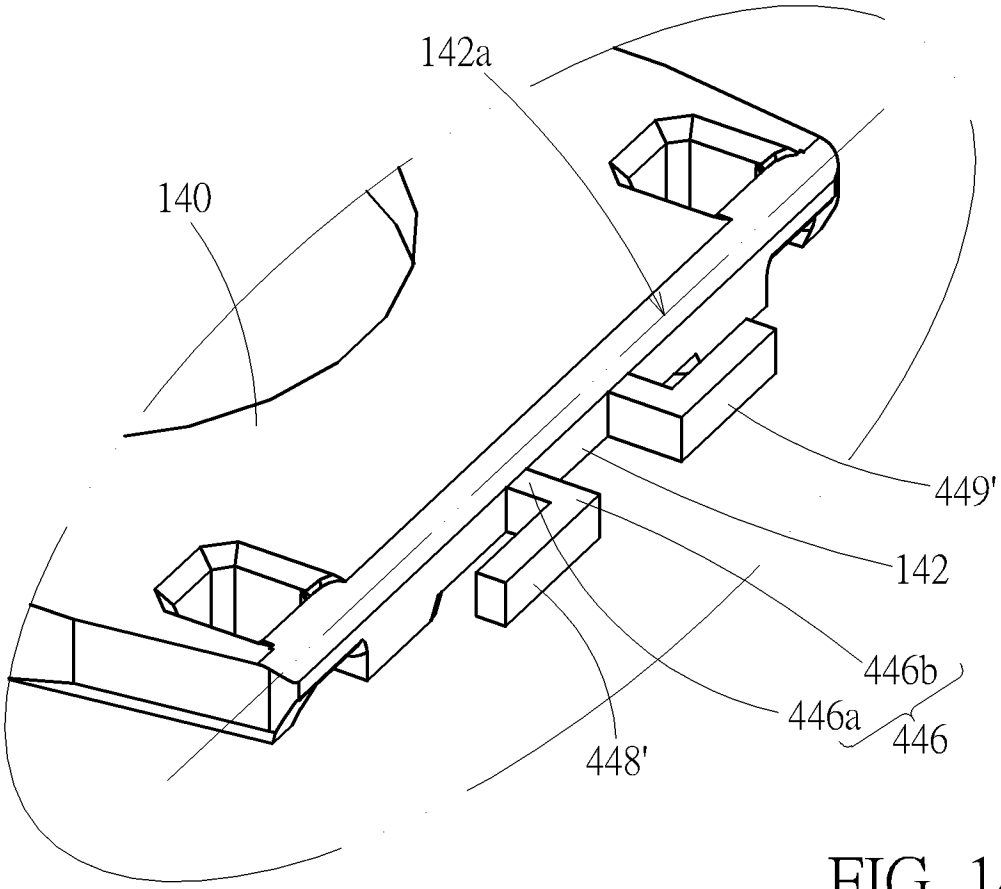
FIG. 14 is a schematic diagram illustrating a portion of the first support according to an embodiment.
Figure 15:
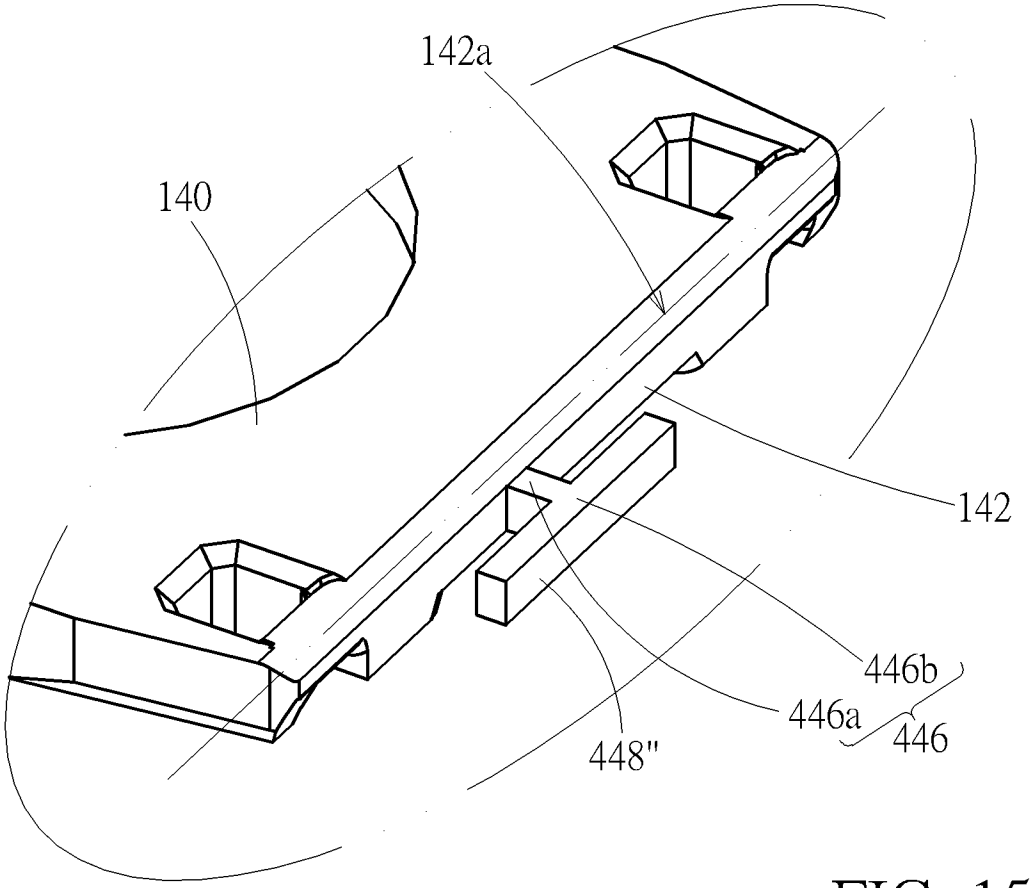
FIG. 15 is a schematic diagram illustrating a portion of the first support according to an embodiment.

Furthermore, in the embodiment, the first protruding limitation portion 448 extends from the free end portion 446*b* toward the keycap 12 (or the lower surface 120*a* thereof). The first protruding limitation portion 448 extends perpendicular to the rotation axis 142*a* toward the keycap 12. The extending connection portion 446 extends perpendicular to the rotation axis 142*a* and an extension direction of the first protruding limitation portion 448. However, it is not limited thereto in practice. For example, the extension direction of the extending connection portion 446, the extension direction of the first protruding limitation portion 448, and the rotation axis 142*a* are not perpendicular to each other. For another example, the first protruding limitation portion 448' extends parallel to the rotation axis 142*a*, as shown by FIG. 14. For another example, the first protruding limitation portion 448" extends parallel to the rotation axis 142*a* from two opposite sides of the free end portion 446*b*; that is, the free end portion 446*b* is connected to a middle portion of the first protruding limitation portion 448", as shown by FIG. 15.

Figure 16:
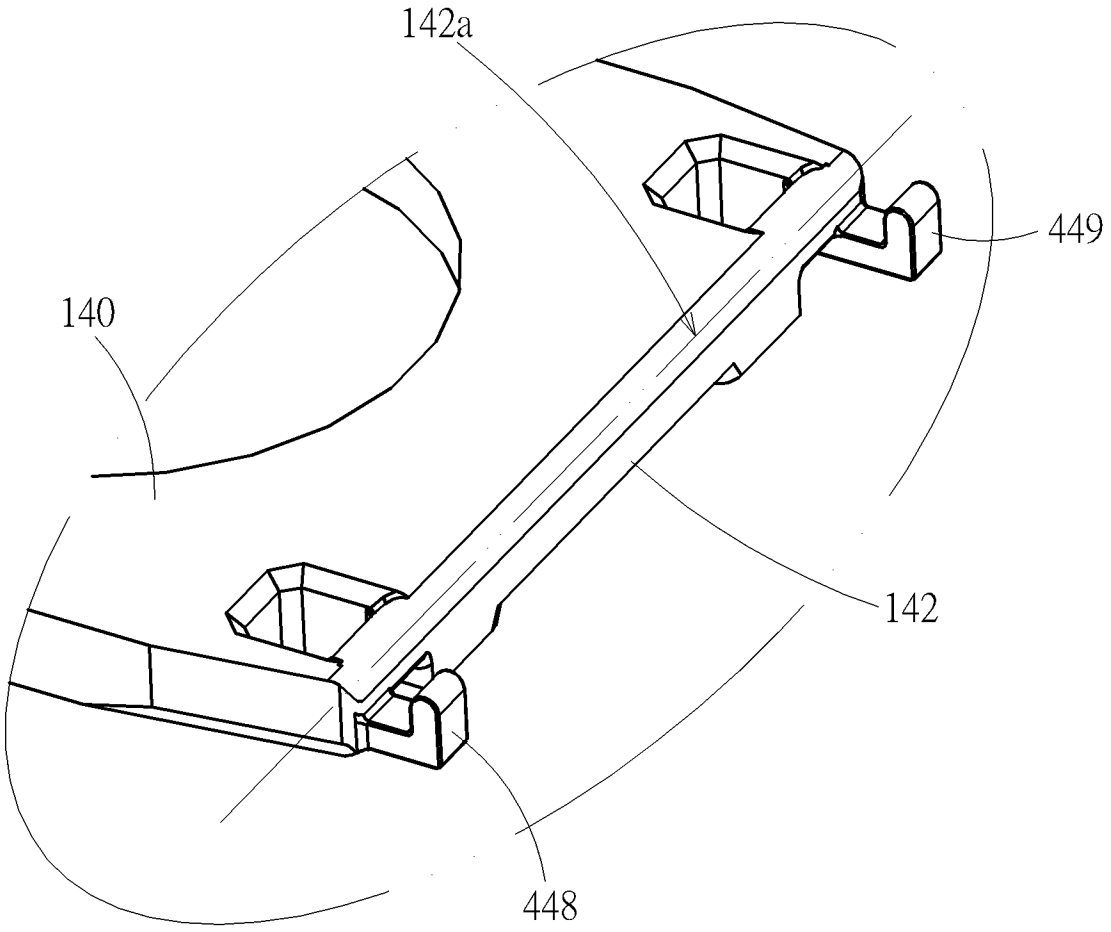
FIG. 16 is a schematic diagram illustrating a portion of the first support according to an embodiment.

Please refer to FIG. 9 and FIG. 12. The first support 14 has a third protruding limitation portion 449. The third protruding limitation portion 449 is structurally the same as the first protruding limitation portion 448 for simplification of description; however, it is not limited thereto in practice. Therein, an abutting position 120*d* of the lower surface 120*a* that the third protruding limitation portion 449 touches is indicated by a hatched rectangle in FIG. 12. In the embodiment, the first protruding limitation portion 448 and the third protruding limitation portion 449 are located between the two connection structures 122 of the keycap 12; however, it is not limited thereto in practice. For example, the first upper connection portion 142 and the two connection structures 122 of the keycap 12 are located between the first protruding limitation portion 448 and the third protruding limitation portion 449. The two connection structures 122 are also located between the corresponding abutting positions 120*b* and 120*d* (referring to FIG. 16). For another example, just one of the first protruding limitation portion 448 and the third protruding limitation portion 449 is located between the two connection structures 122. Furthermore, as shown by FIG. 14, the first protruding limitation portion 448' and the third protruding limitation portion 449' extend parallel to the rotation axis 142*a* in opposite directions; therein, the first protruding limitation portion 448' and the third protruding limitation portion 449' are also located between the two connection structures 122.

Please refer to FIG. 9 and FIG. 10. The second protruding limitation portion 468 of the second support 16 also elastically abuts against the lower surface 120*a* of the keycap 12; that is, a prepressing exists between the second protruding limitation portion 468 and the lower surface 120*a*. The prepressing is conducive to avoidance of a wobble of the keycap 12. The structural constraint between the second protruding limitation portion 468 and the keycap 12 is essentially the same as the structural constraint between the first protruding limitation portion 448 and the keycap 12 in logic. Thereby, for other descriptions about the second protruding limitation portion 468, please refer to the relevant descriptions of the first protruding limitation portion 448 and the descriptions about the variants thereof, which will not be repeatedly described. Furthermore, in practice, the quantity and locations of the protruding limitation portions on the first support 14 and the second support 16 can be determined by product design and not limited to the above embodiments. In practice, even if only one protruding limitation portion is used in the keyswitch structure 4, it is still conducive to the stability of the keycap 12 at the un-pressed position, which will not be described in addition.

Figure 17:
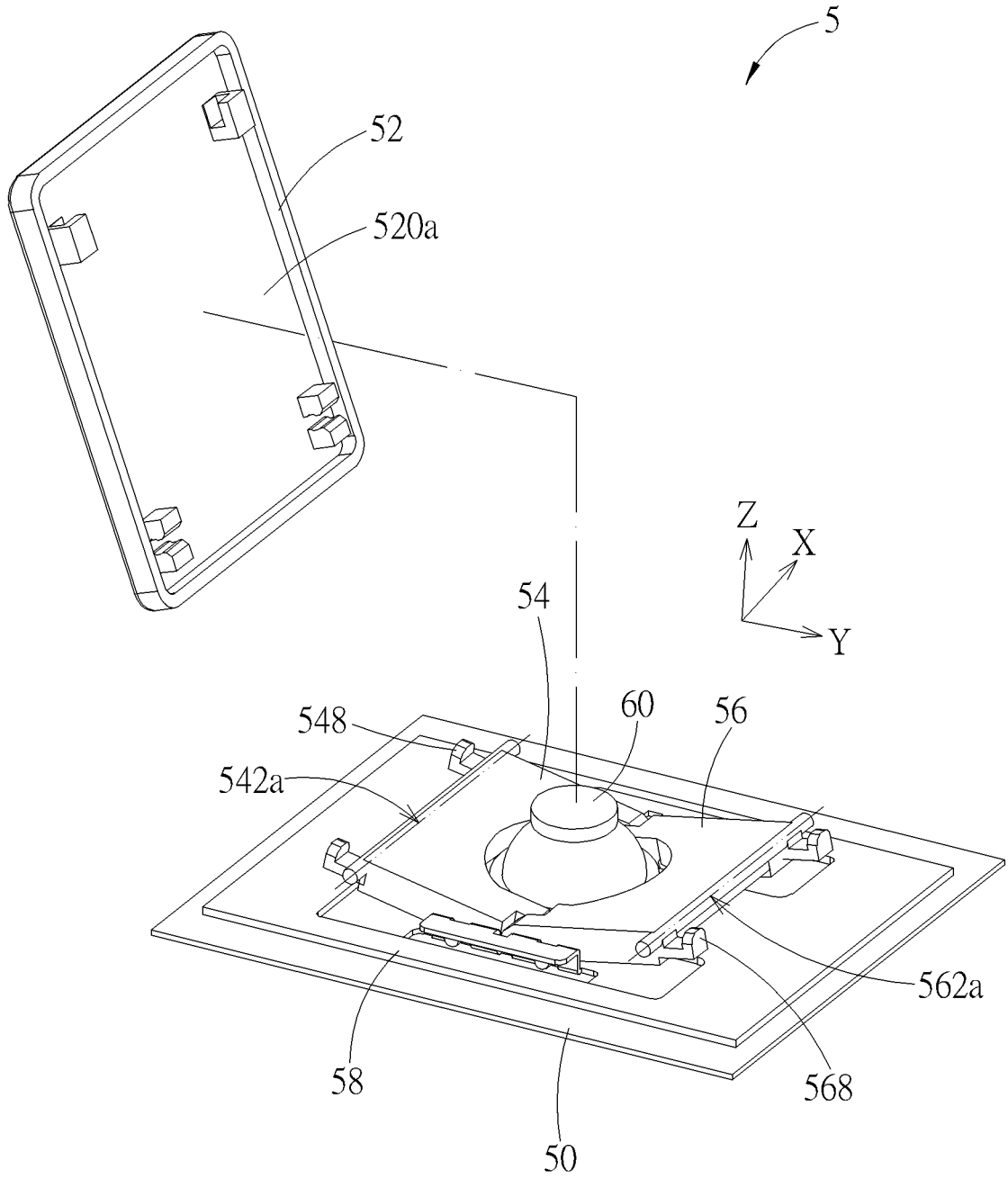
FIG. 17 is a partially-exploded view of a keyswitch structure according to an embodiment.

In the embodiment, the keyswitch structure 4 is illustrated to be with a scissors-type support; however, it is not limited thereto in practice. For example, as shown by FIG. 17, a keyswitch structure 5 uses a butterfly-type support. A first support 54 and a second support 56 thereof are pivotally connected with each other to be disposed in a V-shaped configuration and are individually connected to a keycap 52 and a base plate 50 thereof. The keycap 52 can move up and down relative to the base plate 50 through the first support 52 and the second support 54. A resilient part 60 is used therein for producing resilient force. When the keycap 52 is not pressed yet, a first protruding limitation portion 548 disposed on the first support 54 and a second protruding limitation portion 568 on the second support 56 elastic abut against a lower surface 520*a* of the keycap 52, which is conducive to avoidance of a wobble of the keycap 52. In an aspect on the structural constraint between the keycap 52 and the protruding limitation portions 548 and 568, the keyswitch structure 5 and the keyswitch structure 4 are essentially the same. Thereby, the relevant descriptions of the keyswitch structure 4 and the descriptions about the variants thereof are also applicable herein, which will not be repeatedly described.

Figure 18:
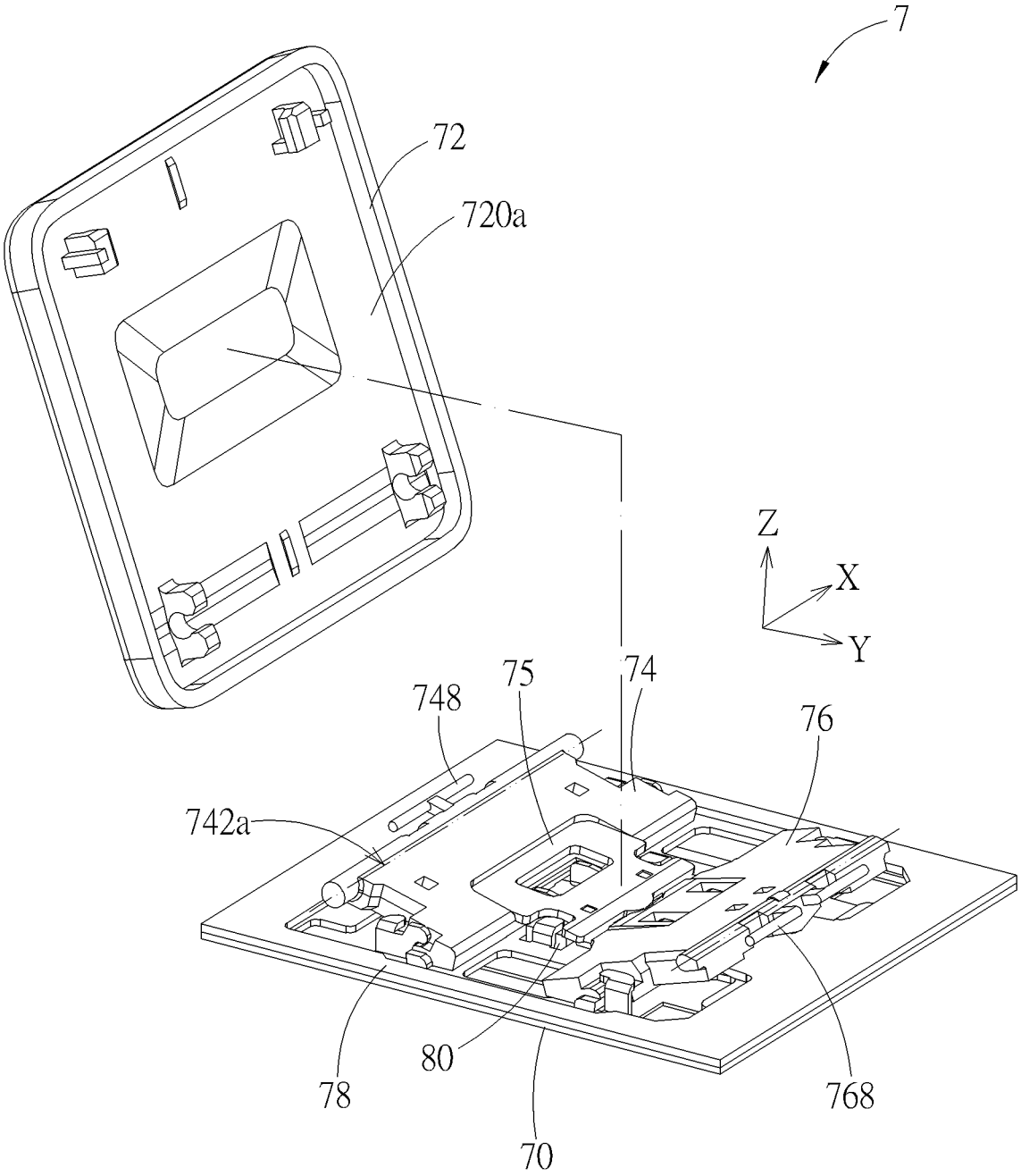
FIG. 18 is a partially-exploded view of a keyswitch structure according to an embodiment.

For another example, as shown by FIG. 18, the keyswitch structure 7 is a magnet keyswitch. A first support 74 and a second support 76 thereof are individually connected to and between the keycap 72 and the base plate 70. A metal plate 75 thereof is fixedly connected to the first support 74 and abuts against the second support 76. A magnet 80 is disposed on the base plate 70 corresponding to the metal plate 75. The magnet 80 and the metal plate 75 produce a magnetic attraction force therebetween, so as to link the first support 74 and the second support 76 through the metal plate 75, so that the keycap 72 can move up and down relative to the base plate 70 through the first support 74 and the second support 76. Therein, the magnetic attraction force is taken as the force for returning the keycap 72 to its original position. When the keycap 72 is not pressed yet, the first protruding limitation portion 748 disposed on the first support 74 and the second protruding limitation portion 768 disposed on the second support 76 elastically abut against the lower surface 720*a* of the keycap 72, which is conducive to avoidance of a wobble of the keycap 72. In an aspect on the structural constraint between the keycap 72 and the protruding limitation portions 748 and 768, the keyswitch structure 7 and the keyswitch structure 4 are essentially the same. Thereby, the relevant descriptions of the keyswitch structure 4 and the descriptions about the variants thereof are also applicable herein, which will not be repeatedly described.

Figure 19:
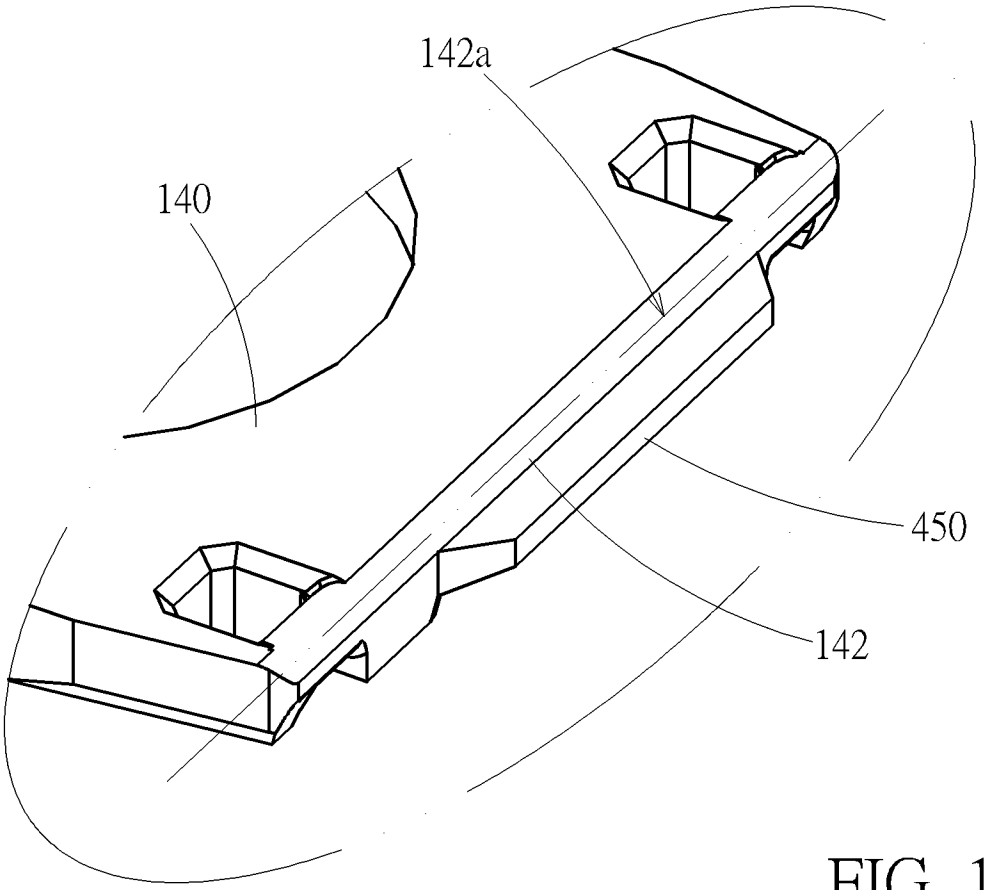
FIG. 19 is a schematic diagram illustrating a portion of the first support according to an embodiment.

Furthermore, in the keyswitch structures 4, 5 and 7, the protruding limitation portions are connected to the corresponding extending connection portions respectively, which is conducive to the elasticity of the elastic structure (formed by the protruding limitation portion and the corresponding extending connection portion). However, it is not limited thereto in practice. For example, as shown by FIG. 19, the first protruding limitation portion 450 extends directly from the first upper connection portion 142, which also can form a cantilever structure. The free end of the cantilever can elastically abut against the lower surface 120*a* of the keycap 12 when the keycap 12 is not pressed yet (referring to FIG. 10), which is also conducive to avoidance of a wobble of the keycap 12.

In addition, the butterfly-type support and the magnet-type support showed in the keyswitch structures 5 and 7 also can be applied to the keyswitch structures 1 and 3, which will not be described further.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A keyswitch structure, comprising: a base plate; a keycap disposed above the base plate; a first support connected to and between the keycap and the base plate, the first support having a first upper connection portion, a first lower connection portion, and a first protruding limitation portion, the first upper connection portion being located between the first lower connection portion and the first protruding limitation portion, the first support being rotatably connected to the keycap and the base plate through the first upper connection portion and the first lower connection portion respectively, the first protruding limitation portion being disposed close to and under the keycap; and a second support connected to and between the keycap and the base plate, the keycap moving up and down along a vertical direction relative to the base plate through the first support and the second support; wherein the keycap comprises a cap body and a first limitation structure, the first limitation structure is disposed on the cap body and has a first blocking portion, the first blocking portion is located between the cap body and the base plate, and the first protruding limitation portion is disposed between the first blocking portion and the cap body; wherein the first limitation structure has a side wall portion, the side wall portion connects the first blocking portion and the cap body, the side wall portion, the first blocking portion, and the cap body form a sliding slot therebetween, and the first protruding limitation portion slides in the sliding slot; wherein the first upper connection portion is rotatable around a rotation axis relative to the keycap, the first support has an extending connection portion, the extending connection cordon extends outward relative to the first lower connection portion and perpendicular to the rotation axis from the first upper connection portion, and the first protruding limitation portion extends parallel to the rotation axis from the extending connection portion.

2. The keyswitch structure according to claim 1, wherein when the keycap is un-pressed, the keycap is located at an un-pressed position and the first protruding limitation portion abuts against a surface of the first blocking portion that faces toward the cap body.

3. The keyswitch structure according to claim 2, wherein when the keycap is located at the un-pressed position, the first protruding limitation portion abuts against a surface of the cap body that faces the first blocking portion.

4. The keyswitch structure according to claim 3, wherein the first upper connection portion is rotatable around a rotation axis relative to the keycap, and a section of the first protruding limitation portion perpendicular to the rotation axis has an ellipse profile.

5. The keyswitch structure according to claim 1, wherein the keycap comprises a second limitation structure, the second limitation structure is disposed on the cap body and has a second blocking portion, the second blocking portion is located between the cap body and the base plate, the second support has a second upper connection portion, a second lower connection portion, and a second protruding limitation portion, the second upper connection portion is located between the second lower connection portion and the second protruding limitation portion, the second support is rotatably connected to the keycap and the base plate through the second upper connection portion and the second lower connection portion respectively, and the second protruding limitation portion is disposed between the second blocking portion and the cap body.

6. The keyswitch structure according to claim 1, wherein the keycap comprises a pivotal connection structure, and the first upper connection portion is pivotally connected to the pivotal connection structure.

7. The keyswitch structure according to claim 1, further comprising a resilient part that abuts against and between the keycap and the base plate.

8. The keyswitch structure according to claim 1, wherein the first support is pivotally connected to the second support.

* * * * *